United States Patent [19]

Ruston, Sr.

[11] Patent Number: 4,711,030

[45] Date of Patent: Dec. 8, 1987

[54] VARIABLE SPEED FILLET KNIFE

[76] Inventor: Robert B. Ruston, Sr., P.O. Box 357, Merryville, La. 70653

[21] Appl. No.: 859,463

[22] Filed: May 5, 1986

[51] Int. Cl.[4] ..... B26B 7/00

[52] U.S. Cl. ..... 30/272 A; 30/DIG. 1

[58] Field of Search ..... 30/272 A, 272 R, DIG. 1, 30/228

[56] References Cited

U.S. PATENT DOCUMENTS

| | | | |
|---|---|---|---|
| 3,308,536 | 3/1967 | Freedman | 30/272 |
| 3,328,001 | 6/1967 | Zasadny | 30/272 A |
| 3,337,954 | 8/1967 | Robison | 30/272 |
| 3,359,637 | 12/1967 | Hansen | 30/272 |
| 3,388,470 | 6/1968 | Ufer | 30/272 A |
| 3,417,469 | 12/1968 | Cousins et al. | 30/272 |
| 3,432,702 | 3/1969 | Chambers | 310/50 |
| 3,555,678 | 1/1971 | Algulnick | 30/272 A |
| 3,604,114 | 9/1971 | Swanke | 30/272 A |
| 3,664,021 | 5/1972 | Sawyer | 30/272 A |
| 3,757,194 | 9/1973 | Weber | 30/228 |
| 3,896,364 | 7/1975 | Reister | 30/DIG. 1 |
| 4,432,117 | 2/1984 | Iskiw | 17/66 |

*Primary Examiner*—E. R. Kazenske

*Assistant Examiner*—Michael D. Folkerts

*Attorney, Agent, or Firm*—Dennis T. Griggs

[57] ABSTRACT

A portable, hand-held electric knife having dual cutting blades is powered by a DC electric motor which draws its operating current from a remote storage battery. The cutting blades are mechanically coupled to the armature shaft of the DC electric motor by a gear assembly in which a pair of bevel gears are mounted for free rotation on a support shaft and are engaged by a beveled pinion gear attached to the rotor armature. Each blade is movably coupled to a selected bevel gear by a pin. In response to rotation of the drive pinion, the beveled gears are driven in counter-rotating motion. As the driven gears rotate, the blades are extended and retracted in side-by-side relation. A fulcrum shaft is received through aligned slots formed in the blades. Linear reciprocating movement of the blades relative to each other is stabilized and arcuate reciprocating movement of the coupled blades is effected as the blades pivot about the fulcrum shaft. According to this arrangement, the coupled blades undergo simultaneous linear reciprocal movement along parallel paths of extension and retraction, and arcuate reciprocal movement about a path transverse thereto.

6 Claims, 4 Drawing Figures

VARIABLE SPEED FILLET KNIFE

FIELD OF THE INVENTION

This invention relates generally to an electrically-operated knife, and in particular to a battery-powered, hand-held fillet knife.

BACKGROUND OF THE INVENTION

Electric slicing knives which are powered by household alternating current are in widespread use and are commonly used in the home for carving baked meats such as roast turkey, beef roasts, baked hams and the like. Such knives typically include a pair of blades which are reciprocated in sliding contact with each other by an AC induction motor contained within the handle of the assembly. The blades are coupled in side-by-side, sliding relation, with the rotary movement produced by the AC motor being converted to linear, counter-reciprocating movement of the blades. Each blade is provided with a serrated edge which produces an efficient slicing action when reciprocated.

There are a variety of situations in which domestic alternating current power is not available, but 12-volt DC storage battery power is available, for example in boats, automobiles, travel trailers and motor homes. The 12-volt direct current re-chargeable storage battery commonly used in such vehicles has a large reserve capacity and can sustain continuous loading for an extended period of time. Such batteries are therefore capable of providing operating power for a DC electric knife, and because of the low voltage levels involved, can be operated relatively safely as compared with household units which are powered by 110 volts AC.

DESCRIPTION OF THE PRIOR ART

Electric knives are available which include a DC electric motor powered by one or more small batteries contained within the handle of the assembly. Acceptance of such units has been somewhat limited because of the relatively low reserve capacity of the small batteries. The batteries also occupy space within the handle which could be allocated to a larger, more powerful electric motor. Consequently, such self-powered units are characterized by low cutting power and limited operational time between battery replacement or recharging. Moreover, the presence of one or more batteries within the handle enlarges the diameter of the handle and increases the overall weight of the hand-held assembly.

In sports fishing, it is desirable to fillet the fish soon after they are caught, either in the boat or at camp. Hand-held electric knives of the type having self-contained batteries do not have adequate reserve capacity and often do not have adequate cutting power for filleting large game fish, for example fish weighing six pounds or more. Larger fish require additional power for cutting through bone structure. Conventional electric knives powered by small batteries housed within the handle lack sufficient cutting power for such applications.

In the course of operating an electric knife to carve a fillet from the bone structure of a fish, it is desirable to move the knife assembly inwardly and outwardly generally in a plane parallel with the bone structure as the blades are reciprocated. Such arcuate movement is effective essentially by manipulation of the wrist to bring about an inward and outward transverse movement of the dual blades as they are thrust along the bone structure and the fillet portion is peeled away. This wrist movement, if carried out over an extended period, is tiring and is difficult to perform in those regions in which the bone structure is curved.

OBJECTS OF THE INVENTION

It is, therefore, an object of the invention to provide an improved, portable electric knife which draws its operating power from a DC storage battery.

Another object of the invention is to provide an improved gear drive for a dual blade electric knife which causes the blades to reciprocate linearly with respect to each other while at the same time the blades are reciprocated arcuately with respect to the direction of linear movement.

It is a further object of the present invention to provide a hand-held, power-operated slicing knife of the type employing dual blades having an improved drive for converting the rotary motion of an electric motor to counter-reciprocating linear motion of the blades.

SUMMARY OF THE INVENTION

The foregoing objects are achieved by the present invention in which a portable, hand-held electric knife having dual cutting blades is powered by a DC electric motor, with operating current being provided through power conductors connected to a remote storage battery. The blades are mechanically coupled to the armature shaft of the DC electric motor by a gear assembly in which a pair of bevel gears are mounted for free rotation on a shaft and are engaged by a beveled pinion gear attached to the rotor armature. Each blade is movably coupled to a selected bevel gear by a pin. In response to rotation of the drive pinion, the beveled gears are driven in counter-rotating motion. As the driven gears rotate, the blades are reciprocated linearly in side-by-side relation.

According to an important aspect of the invention, a slot is formed through an intermediate portion of each blade, with a fulcrum shaft being received through the aligned slots. In this arrangement, linear reciprocating movement of the blades relative to each other is stabilized, and arcuate reciprocating movement of the coupled blades is effected as the blades pivot about the fulcrum shaft. That is, the coupled blades undergo simultaneous linear reciprocal movement and arcuate reciprocal movement along a path transverse to the path of linear extension and retraction.

The superior features and advantages of the present invention will be further appreciated by those skilled in the art upon reading the detailed description which follows in conjunction with the attached drawings.

DETAILED DESCRIPTION OF THE PREFERRED EMBODIMENT

In the description which follows, like parts are indicated throughout the specification and drawings with the same numerals, respectively. The drawings are not necessarily to scale and certain parts have been exaggerated to better illustrate details of the present invention.

Figure 1:
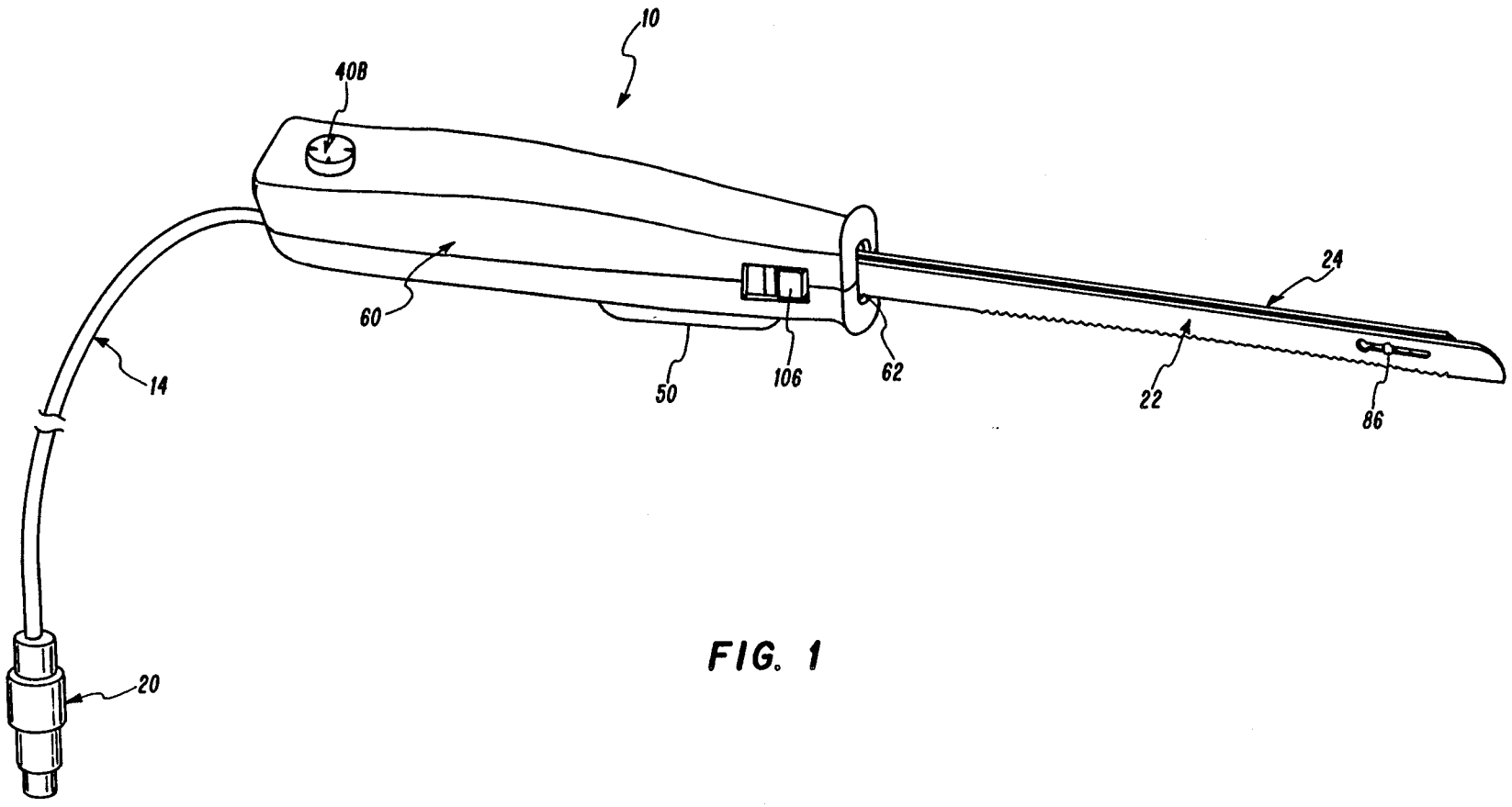
FIG. 1 is a perspective view of a hand-held electric knife which derives its operating power from a remote storage battery.

Referring now to FIG. 1, an electric fillet knife 10 constructed according to the teachings of the present invention is illustrated in its preferred form as a hand-held, portable unit which derives its operating power from a storage battery 12. The storage battery 12 is electrically coupled to the knife assembly by a dual conductor power cable assembly 14. The power cable assembly 14 includes a first conductor 14A attached to the positive electrode of the storage battery 12 by a clip connector 16, and a second conductor 14B attached to the negative electrode of the storage battery 12 by clip connector 18. The storage battery 12 is preferably rated at 12 volts DC and is remotely located with respect to the point of use. The electric knife assembly 10 is releasably connected to the dual conductor power cable 14 by an interconnect power coupling 20.

Dual blades 22, 24 are mechanically driven in side-by-side, sliding relation in linear, counter-reciprocating movement by a DC electric motor 26 which is energized by current conducted through the dual conductor power cable assembly 14 from the DC storage battery 12. The DC motor 26 includes a wound rotor armature 28 which is concentrically received within a stator field winding 30. The stator field winding 30 is connected in series electrical relation with the rotor armature 28. Current for driving the motor 26 is applied to the armature 28 through brushes 32, 34 which wipe against a commutator 36. The commutator 36 is mounted on the armature shaft 38 and rotates with it.

When current is passed through the armature winding 28, the magnetic fields of the armature and stator are attracted to place themselves in alignment with each other. As a result, the armature 28 develops a torque (turning force) about its shaft 38. The magnitude of the torque is proportional to the strength of the magnetic field and of the current. In the series stator field arrangement shown in FIG. 3, the field and armature windings are connected in series, so that the strength of the field is dependent upon the motor load and varies with the armature current.

Thus the cutting force and speed of the blades 22, 24 can be varied by increasing and decreasing the current flow through the armature 28. This is carried out in the present invention by a variable field resistor 40 which is connected in electrical series relation with the stator field winding 30. The resistance value and field current are altered by moving the wiper arm 40A of the potentiometer 40. The setting of the wiper arm 40A is manually adjustable, with the setting being indicated by a knob 40B.

Figure 3:
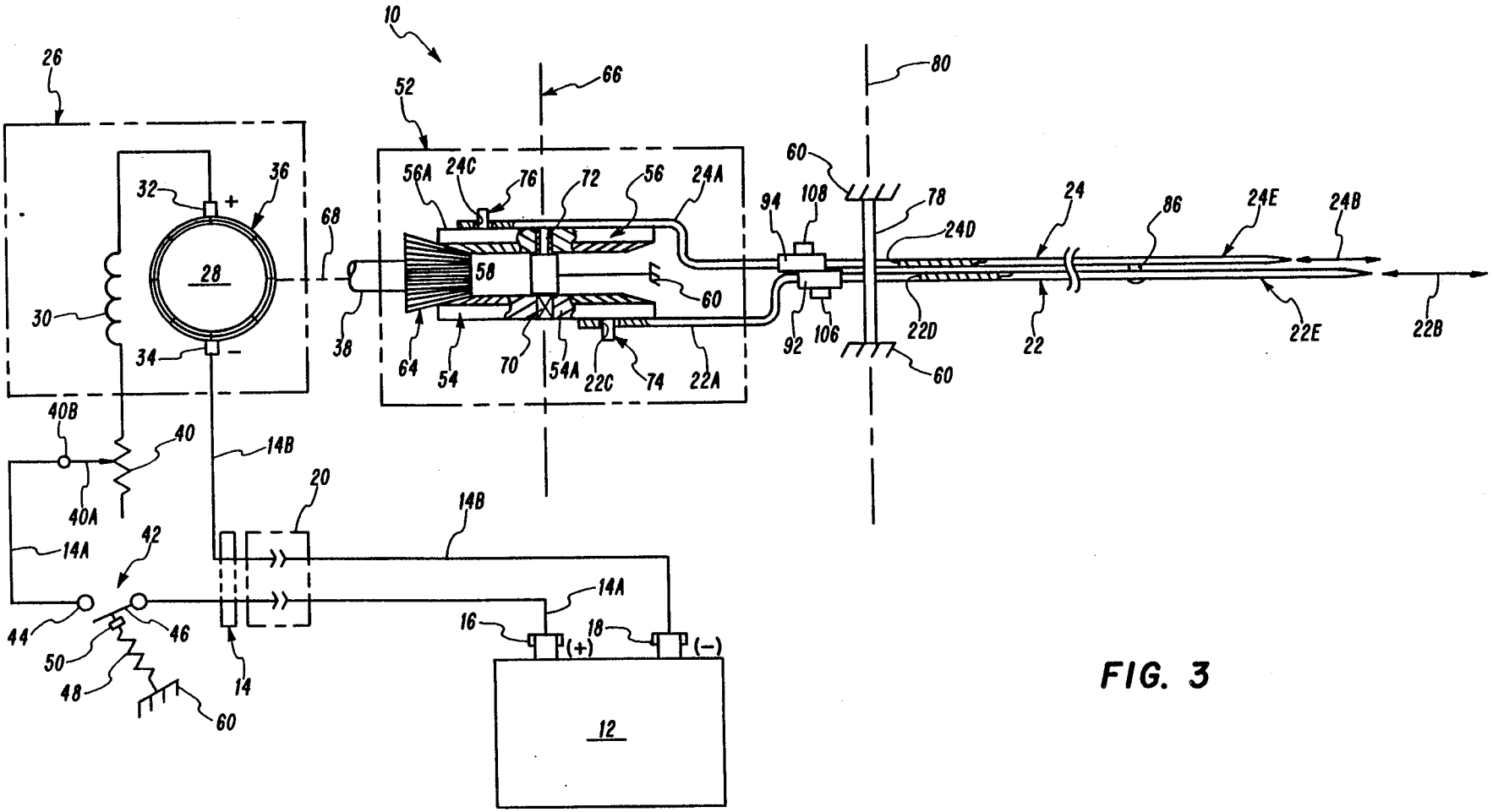
FIG. 3 is a simplified electro-mechanical diagram in which a top plan view of the mechanical gear and blade assembly is coupled to the rotor armature of a DC electric motor; and, FIG. 4 is an elevation view, partly in section and partly broken away, of a blade coupling assembly.

Operating current is selectively applied and interrupted through a spring-loaded on/off switch assembly 42 as shown in FIG. 3. The switch assembly 42 includes a fixed electrode 44 and a movable electrode 46. The movable electrode 46 is biased by a leaf spring 48 to the normally open position as shown in FIG. 3. The electrode 46 is manually movable to circuit closed engagement with the fixed electrode 44 by manipulating a switch actuator 50. The switch 42 is closed and power is applied to the DC motor 26 by manually squeezing the actuator 50. Operating power is interrupted by releasing the actuator 50 which allows the bias spring 48 to automatically retract the movable electrode 46 to the open ciruit position as shown in FIG. 3.

Figure 2:
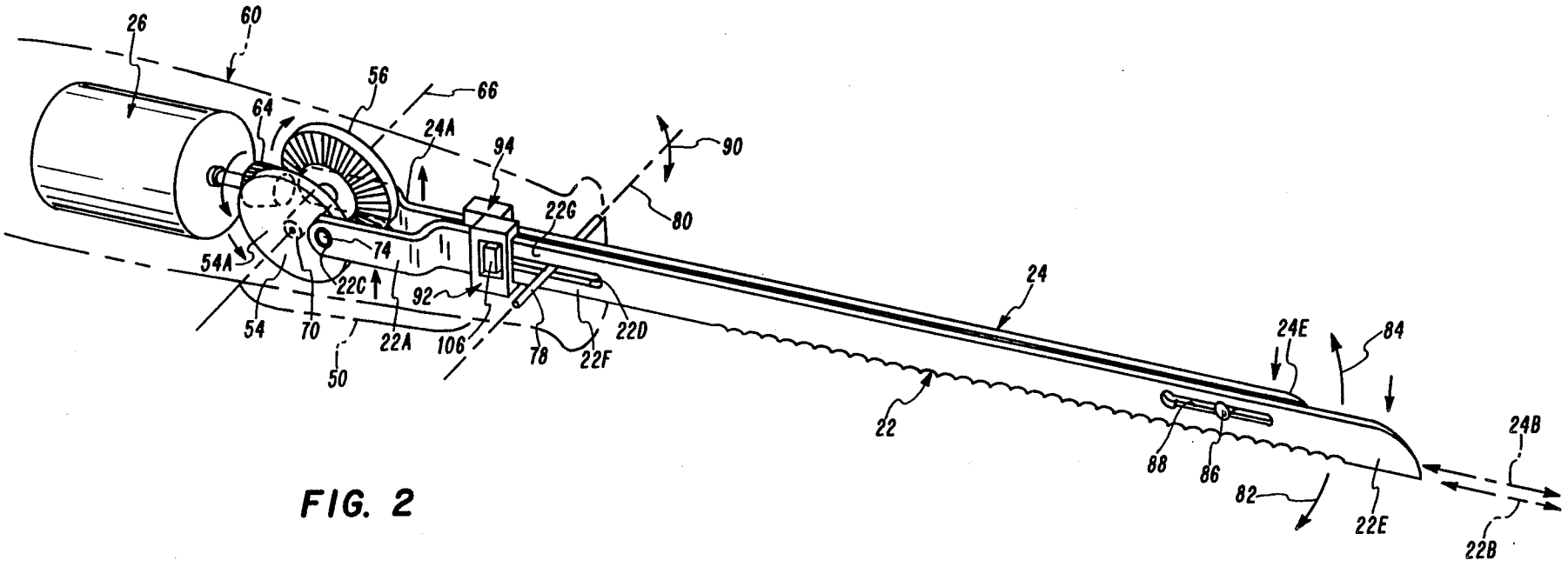
FIG. 2 is a perspective view which illustrates the mechanical coupling of dual blades to a DC electric motor.

Referring now to FIGS. 2 and 3, the cutting blades 22, 24 are mechanically coupled to the armature shaft 38 of the DC electric motor 26 by a gear assembly 52 in which a pair of bevel gears 54, 56 are mounted for free rotation on a support shaft 58. The support shaft 58 is mechanically attached to a housing 60 in which the DC electric motor 26, switch assembly 42 and gear assembly 52 are enclosed. The housing 60 is provided with a slot 62 through which the dual blades 22, 24 project.

The bevel gears 54, 56 are engaged by a bevel pinion gear 64 which is mechanically attached in direct drive relation to the armature shaft 38. As can best be seen in FIG. 3, the bevel gears 54, 56 are mounted in parallel relation on the support shaft 58 for free rotation about an axis 66 which extends at a right angle with respect to the rotor armature axis 68. The driven gears 54, 56 are mounted on opposite ends of the support shaft 58 and are supported for rotation by sleeve bearings 70, 72.

Rotation of the rotor armature 28 produces rotation of the armature shaft 38 and drive pinion gear 64 with respect to the rotary axis 68. Counter-clockwise rotation of the pinion 64 produces counter-clockwise rotation of bevel gear 54 and clockwise rotation of bevel gear 56 with respect to rotational axis 66.

The clockwise and counter-clockwise rotary movements of the bevel gears 54, 56 are translated into linear, counter-reciprocating sliding movement of the dual cutting blades 22, 24. This is brought about by movably coupling the dual blades to the bevel gears by a pin coupling arrangement as shown in FIGS. 2 and 3. According to this arrangement, a pin 74 is mounted on the external face 54A of bevel gear 54 and projects outwardly therefrom in right-angle relation. Likewise, a pin 76 is attached to the external face 56A of bevel gear 56, and projects outwardly therefrom in right-angle relation. The pins are angularly offset with respect to each other, preferably by 180 degrees, as indicated in FIG. 3.

The positions of the blades and of the pins in FIG. 3 correspond with the fully extended position of blade 22 and the fully retracted position of blade 24, respectively. The gear assembly 52 includes force transmitting end portions 22A, 24A, respectively, which are laterally offset with respect to the paths 22B, 24B of linear recipocal movement followed by the blades 22, 24, respectively. The force transmitting end portions 22A, 24A are each provided with a circular bore 22C, 24C through which the pins 74, 76 project, respectively.

According to an important feature of the present invention, movement of each blade is stabilized and coordinated by a fulcrum shaft 78. The fulcrum shaft 78 is lodged within the housing 60 and provides pivotal support for the dual blades 22, 24. Elongated slots 22D, 24D are formed in the blades 22, 24, respectively, through which the fulcrum shaft 78 projects from one side of the housing 60 to the other. The clearance provided by the elongated slots allows the blades to extend and retract independently of each other.

Because the coupling pins 74, 76 are angularly displaced by 180 degrees, and because they are located at a common radial distance with respect to the rotation axis 66, the blades 22, 24 are constrained to pivot synchronously about the fulcrum shaft 78 as the bevel gears 54, 56 rotate clockwise and counter-clockwise with respect to the axis 66. As can best be seen in FIG. 2, as bevel gear 54 rotates counter-clockwise, pin 74 rotates counter-clockwise and the blade coupling portion 22A is lifted vertically and retracted along path 22B as pin 74 rotates counter-clockwise. Simultaneously with the counter-clockwise movement of bevel gear 54, bevel gear 56 is rotated in clockwise rotation with respect to axis 66. Pin 76 is also driven in clockwise rotation, which lifts blade coupling portion 24A vertically and moves it outwardly in extension along the path 24B.

Because the blades pivot about a common axis 80 coincident with the support fulcrum 78, the blade end portions 22E, 24E move synchronously downwardly and upwardly as indicated by the arrows 82, 84 respectively. Upon reversal of the direction of arcuate motion, the direction of arcuate movement is also reversed. The direction of arcuate motion reverses upon the completion of each 180-degree rotation of the pins 74, 76.

The side-by-side sliding reciprocal linear movement of the blades 22, 24 is further stabilized by a rivet 86 which is fastened to blade 24 and which is received within an elongated slot 88 formed within blade 22.

Figure 4:
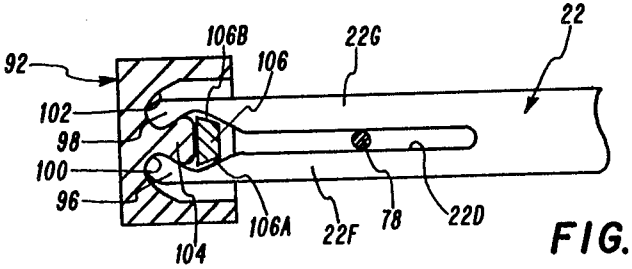

Referring now to FIGS. 2, 3 and 4, each blade is releasably attached to its corresponding force transmitting members 22A, 24A by blade holders 92, 94, respectively. The laterally offset force transmitting stub portions 24A, 26A are rigidly attached to the blade holders 92, 94, respectively. The coupling end of each blade is bifurcated by an elongated slot. For example, slot 22D separates blade end portions 22F, 22G. The coupling end portions of blade 22 are terminated by inwardly curved latch portions 96, 98 respectively, which are received within conforming sockets 100, 102, respectively. Because of the bifurcated structure, the curved latch portions are deflectable with respect to each other. The bifurcated coupling end portions deflect outwardly away from each other as they are forced onto a stub 104 disposed intermediate the sockets 100, 102.

The coupling end portions are engaged by a release actuator 106, 108, respectively. Each release actuator includes tapered surfaces, for example surfaces 106A, 106B, with release of a blade being obtained by depressing the actuator inwardly to spread apart the bifurcated end portions to permit them to be withdrawn from their sockets. For example, by depressing actuator 106 inwardly, the curved latch portions 96, 98 are spread apart slightly out of their respective sockets, thereby permitting blade 22 to be removed from the knife assembly 10. As it is withdrawn, the bifurcated blade end portions 22F, 22G slip relative to fulcrum shaft 78, with the fulcrum shaft 78 being received in registration with the aligned slots 22D, 24D. As the bifurcated end portions are pushed into the blade holder, the curved latch portions 96, 98 snap into detented engagement within the conforming sockets, as the bifurcated end portions momentarily deflect outwardly and then inwardly.

According to the foregoing arrangement, the dual blades 22, 24 are constrained to move in side-by-side, linear counter-reciprocal motion, while simultaneously undergoing arcuate, synchronous reciprocal movement as indicated by the arrow 90 with respect to the fulcrum axis 80. The linear counter-reciprocal movement and arcuate synchronous movement are produced by the interaction of the counter-rotating parallel bevel gear assembly 54, 56 with the rotary pin connection of the force transmitting members 22A, 24A together with the fulcrum support provided by the shaft 78.

Although the invention has been described with reference to a specific embodiment, and with reference to a specific battery-powered application, the foregoing description is not intended to be construed in a limiting sense. Various modifications of the disclosed embodiment as well as alternative applications of the invention will be suggested to persons skilled in the art by the foregoing specification and illustrations. For example, the rotary motion conversion gear assembly can be used to good advantage in combination with an AC induction motor which is powered by domestic alternating current as well as the DC motor as illustrated. Although a DC drive motor which derives its operating power from a remote DC storage battery is preferred, the principles of the invention may be incorporated in a hand-held portable knife assembly which derives its power from batteries enclosed within its housing. Finally, although a DC electric motor having a series field winding has been described for purposes of illustration, other field winding arrangements, for example shunt and compound, can be used to good advantage. It is therefore contemplated that the appended claims will cover any such modifications or embodiments that fall within the true scope of the invention.

What is claimed is:

1. A portable, hand-held electric knife having dual cutting blades, a DC electric motor, power conductors electrically connected to the DC electric motor for conducting current from a remote storage battery, the DC electric motor including an armature shaft and a gear assembly mechanically coupling the dual cutting blades to the armature shaft, the gear assembly including a support shaft, a pair of bevel gears mounted for rotation on opposite ends of said support shaft, a beveled pinion gear engaged with said first and second bevel gears, said beveled pinion gear being mechanically coupled to the armature shaft of said DC electric motor, each cutting blade including a force transmitting end member movably coupled to one of the beveled gears for converting rotary motion of said armature shaft to linear counter-reciprocating motion of said cutting blade, each cutting blade having an elongated slot formed intermediate the force transmitting member and the cutting end, with the respective elongated slots being disposed in overlapping alignment with each other; and, a fulcrum shaft lodged within said housing and projecting through said overlapping slots.

2. An electrically-operated knife as defined in claim 1, including a releasable blade coupling interposed between the force transmitting member and each cutting blade, respectively;

each blade having a coupling end portion bifurcated by an elongated slot, with the respective elongated slots of said blades being disposed in overlapping alignment with each other;

said bifurcated end portions being terminated by latch portions;

said coupling member including first and second sockets, each socket being conformed for detented engagement with said latch portions; and, a release actuator disposed between said bifurcated end portions for engaging and spreading said bifurcated end portions apart to cause said latch portions to deflect outwardly with respect to each other and to release detented engagement with the respective sockets.

3. Apparatus for converting rotary motion of the rotor element of a motor to linear reciprocating motion and arcuate reciprocating motion of a blade comprising, in combination:

a gear assembly for mechanically coupling the blade to the rotor element of the motor, the gear assembly including a support shaft, a bevel gear mounted for rotation on said support shaft, a beveled pinion gear engaging said bevel gear in driving relation, said beveled pinion gear being mechanically coupled to said rotor element, the blade including a force transmitting end member movably coupled to the driven bevel gear for converting rotary motion of said rotor element into linear counter-reciprocating motion and arcuate reciprocating motion of said blade, said bevel gear including a pin, the force transmitting member of said blade having a bore through which said pin projects, said blade having an elongated slot formed intermediate the force transmitting member and its opposite end, and a fulcrum shaft projecting through said slot, said fulcrum shaft constraining counter-reciprocating movement of said blade along a linear path in extension and retraction, while constraining arcuate reciprocating motion of said blade along an arcuate path transverse with respect to said linear path.

4. A blade assembly for use in combination with a force transmitting member comprising, in combination:

a coupling block for attachment to said force transmitting member, said coupling block having first and second sockets;

said blade having a coupling end portion bifurcated by an elongated slot, the bifurcated end portions of said blade having latch portions;

said coupling block having a central stub portion disposed intermediate said sockets, said central stub portion having first and second sloping surfaces for engaging and spreading apart said bifurcated end portions as said latch members are inserted into their respective sockets; and, a release actuator disposed intermediate said bifurcated end portions, said release actuator having tapered side surfaces for engaging and spreading apart said bifurcated blade end portions in response to movement of said release actuator transverse with respect to said blade.

5. An electrically-operated knife comprising, in combination:

a housing having a portion defining a handle;

an electric motor mounted on said housing within said handle portion, said motor having a rotor;

first and second cutting blades movably coupled together, said first and second cutting blades each having a force transmitting end portion for insertion into said housing, each cutting blade having a longitudinal slot formed in said blade near said force transmitting end portion;

means coupled to said cutting blades for constraining counter-reciprocating movement of said blades along parallel linear paths in extension and retraction while permitting reciprocating pivoting movement of said blades through an arcuate path relative to said handle portion, said constraining means including a fulcrum pin mounted on said housing, said fulcrum pin being received within said longitudinal slots in said cutting blades; and, rotary motion converting means coupled to said rotor and to the force transmitting end portions of said first and second cutting blades for extending and retracting said blades relative to each other while simultaneously reciprocating said blades through said arcuate path.

6. An electrically-operated knife as defined in claim 5, said rotary motion converting means comprising a gear assembly mechanically coupling said cutting blades to said rotor element, the gear assembly including a support shaft mounted on said housing, first and second driven bevel gears mounted for counter-rotation on said support shaft, a beveled pinion gear simultaneously engaging both first and second driven bevel gears in driving relation, said beveled pinion gear being mechanically coupled to said rotor member, the force-transmitting end portion of each cutting blade being movable coupled to one of said driven bevel gears for converting rotary motion of said rotor element into counter-reciprocating linear motion and arcuate reciprocating motion of said blades.

* * * * *